US005326273A

United States Patent [19]

Kamon et al.

[11] Patent Number: 5,326,273

[45] Date of Patent: Jul. 5, 1994

[54] ELECTRIC CONNECTION TERMINAL

[75] Inventors: Shinji Kamon; Akihisa Mitsuishi; Masaru Shinmura; Toshiya Nishino, all of Saitama; Kazunori Kurata; Toshihisa Sekido, both of Mie, all of Japan

[73] Assignees: Sumitomo Wiring Systems, Ltd., Mie; Honda Giken Kogyo K.K., Tokyo, both of Japan

[21] Appl. No.: 47,005

[22] Filed: Apr. 14, 1993

Related U.S. Application Data

[63] Continuation of Ser. No. 727,737, Jul. 10, 1991, abandoned.

[30] Foreign Application Priority Data

Jul. 13, 1990 [JP] Japan ..... 2-74697[U]
Jun. 5, 1991 [JP] Japan ..... 3-050773[U]

[51] Int. Cl.[5] ..... H01R 4/62

[52] U.S. Cl. ..... 439/92; 439/519; 439/936; 174/94 R

[58] Field of Search ..... 439/519, 886, 936, 92, 439/100; 174/94 R, 84 R

[56] References Cited

U.S. PATENT DOCUMENTS 4,650,274 3/1987 Schmid ..... 439/886
4,820,196 4/1989 Roselle et al. ..... 439/519
5,009,616 4/1991 Fogg et al. ..... 439/936

FOREIGN PATENT DOCUMENTS 1925553 11/1970 Fed. Rep. of Germany ..... 439/519

*Primary Examiner*—Gary F. Paumen
*Attorney, Agent, or Firm*—Sughrue, Mion, Zinn, Macpeak & Seas

[57] ABSTRACT

An electric connection terminal can prevent electric ereosion caused in some equipment made of an aluminum material and attached to a car body for electric conduction of the equipment through the terminal such as an earth bracket which connects an earth line to the car body. The terminal comprises a first attaching member (1) made of an aluminum material and having a connecting portion (4) of a car body at the top end and a coupling portion (6A) at the bottom end, a second attaching member (2) made of a brass material and having a connecting portion (5) of an earth line at the top end and a coupling portion (6B) at the bottom end, and a water-proof layer (3) molded by a plastic resin for interconnecting said coupling portions (6A, 6B) of said first and second attaching members (1, 2) by embedding said portions (6A, 6B) in the plastic resin.

3 Claims, 5 Drawing Sheets

ELECTRIC CONNECTION TERMINAL

This is a continuation of application Ser. No. 07/727,737 filed Jul. 10, 1991 now abandoned.

BACKGROUND OF THE INVENTION

1. Field of the Invention

This invention relates to an electric connection terminal which connects an electric wire to a piece of equipment or to another electric wire to provide an electrical connection, and more particularly to an electric connection terminal, such as an earth bracket, which electrically connects a car body to an earth line drawn out of an electrode in a car to form an earth circuit.

2. Statement of the Prior Art

A conventional electric connection terminal, such as a typical earth bracket, is made of a single metal material such as brass and has a common construction in which an electric wire is connected to one end of the terminal and a piece of equipment is connected to the other end of the terminal.

In reference to the earth bracket, it is expected from the standpoint of car body weight that bodies made of an aluminium material will be come more common in the near future. However, in the conventional construction, the bracket is made of a single metal material, such as brass, the connection between an aluminium member and another member, made of a metal material other than aluminium, for example, between an aluminum body and a brass bracket or, between an aluminium bracket and a copper earth line, are subject to electric erosion of the aluminum material Accordingly, it is necessary in the art to eliminate this problem.

In addition to the earth bracket, any electric connection terminal which connects an aluminium wire to a piece of equipment or to a copper wire is subject to electric erosion.

SUMMARY OF THE INVENTION

An object of the present invention is to provide an electric connection terminal which can prevent electric erosion.

In order to accomplish the above object, an electric connection terminal, such as an earth bracket, in accordance with the present invention has a first attaching member made of an aluminium material and having a connecting portion at the top end and a coupling portion at the bottom end, a second attaching member made of a metal material other than an aluminium material and having a connecting portion at the top end and a coupling portion at the bottom end, and a water-proof layer molded by a plastic resin for interconnecting said coupling portions of said first and second attaching members by embedding said portions in the plastic resin.

The connecting portion of said first attaching member of the aluminium material may be an attaching portion of a car body, and the connecting portion of said second attaching member made of a brass material may be an earth bracket for connecting an earth line.

The connecting portion of the first attaching member of the aluminium material may be an attaching portion of a car body, and the connecting portion of the second attaching member made of a brass material may be a connecting plate for the connection of equipment.

The first attaching member may be made of an aluminium material processed by a chromate treatment, and the second attaching member may be made of brass material plated with tin.

A brass material having a high electric conductivity may be used for the second attaching member made of a different kind of metal material. As a measure for sticking the water-proof layer to the attaching members, a method for previously applying a sealant to a surface of the attaching member is widely used.

In the electric connecting terminal of this invention, for example, the earth bracket, the earth line is connected to the earth connecting portion of the second brass attaching member while the body connecting portion of the first aluminium attaching member is connected to the aluminium body to form the earth circuit. Since the aluminium bracket is connected to the aluminium body and the aluminium part is not connected to the different metal part, electric erosion will not occur.

The coupling portions of a pair of the attaching members which couple the aluminium material to the metal material other than the aluminium material are provided with a water-proof layer of plastic resin which sticks to the surfaces of the coupling portions. Consequently, the coupling portions are prevented from being exposed to water and from being subject to electric erosion due to contact between the aluminium material and the different kind of metal material. Such a method preventing electric erosion can be applied to an electric connection terminal in which an aluminium wire or other equipment is connected to the connecting portion of the first aluminium attaching member, as well as to the earth bracket.

In addition, the combination of the first aluminium attaching member processed by the chromate treatment and the second brass attaching member plated with tin can protect the surface of the aluminium material. Consequently, water is effectively prevented from entering into the space between the water-proof layer and the closely contacted surfaces of the coupling portions for a long time. The tin-plating increases resistance to electric erosion on the second brass attaching member. Thus, the performance of the electric connection terminal is assured over a long term.

DETAILED DESCRIPTION OF THE PREFERRED EMBODIMENTS

Figure 5:
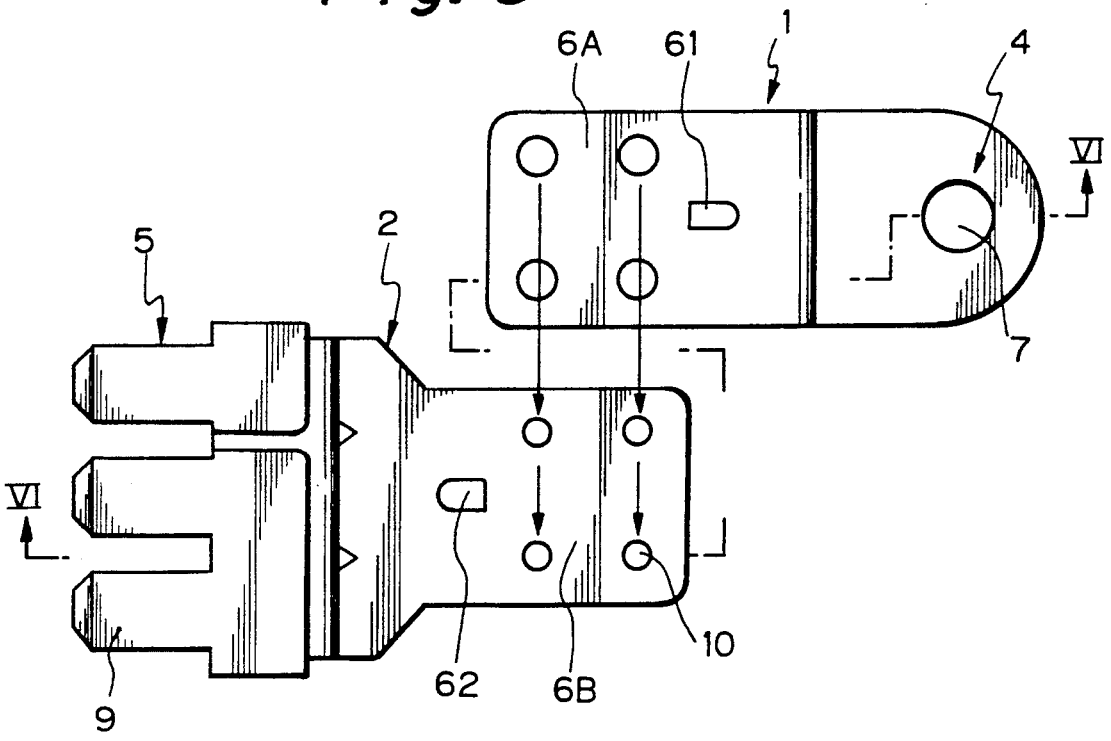
FIG. 5 is a plan view of a pair of attaching members disassembled from each other.

The embodiments of the electric connection terminal in accordance with the present invention will now be explained in detail by referring to the drawings. FIGS. 1 to 7 show an earth bracket for a car or an electric connection terminal of the first embodiment of this invention. The earth bracket comprises a first attaching member 1 made of an aluminium plate material and having a body connecting portion 4 at one end and a coupling portion 6A at the other end, and a second attaching member 2 made of a brass plate material and having an earth connecting portion 5 at one end and a coupling portion 6B at the other end. The coupling portions 6A and 6B of attaching members 1 and 2 are superposed to couple with each other. The superposed coupling portions 6A and 6B are embedded in the plastic resin by a molding process to form a water-proof layer 3 in close contact with the surfaces of the coupling portions 6A and 6B. As best shown in FIG. 5, slots 61 and 62 formed in the attaching members 1 and 2 permit the resin to flow into them when molding, so that the sticking effect between the resin and the surfaces of the coupling portions 6A and 6B can be improved.

Figure 6:
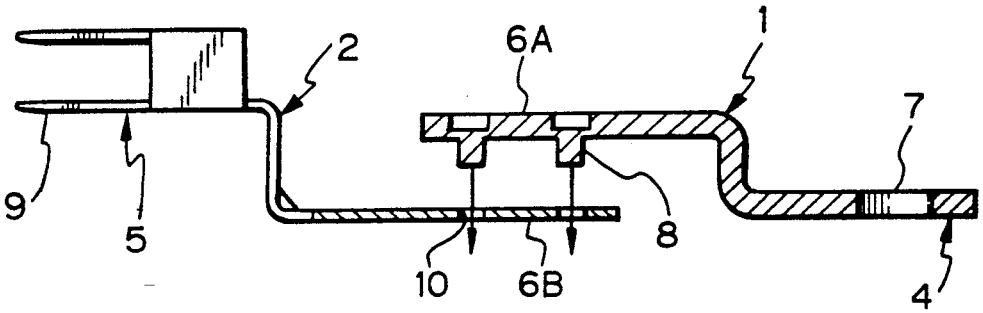
FIG. 6 is a disassembled cross sectional view taken along line VI—VI in FIG. 5.

In FIGS. 5 and 6, the first attaching member 1 includes a bolt hole 7 formed in connecting portion 4 so as to be attached to the car body and embossed rivets 8 in coupling portion 6A. The attaching member 1 is formed by bending the aluminium plate material. The second attaching member 2 includes the earth connecting portion 5 with a plurality of tabs 9 (six tabs in the illustrated embodiment) to be attached to the earth line and, on coupling portion 6B, rivet holes 10 corresponding to the rivets 8. The attaching member 2 is formed by bending the brass plate material. The attaching members 1 and 2 are superposed so that the rivets 8 fit in the rivet holes 10 and then the members 1 and 2 are secured to each other by caulking the rivets 8 onto the rivet holes.

Adhesive liquid (in this invention, achronarl YX-3700D (trade name) may be used, it is applied to the coupling portions between the aluminium plate material and the brass plate material, and exposed portions of the rivets to form and adhesive covering film 11, and then a water-proof layer 3 is formed on the film 11 by molding it with acril system resin, polyamid system resin, or the like, so that the coupling portions 6A and 6B are embedded in the water-proof layer 3.

The rivets 8 may be formed by embossing the aluminium plate material to form protrusions.

Figure 7:
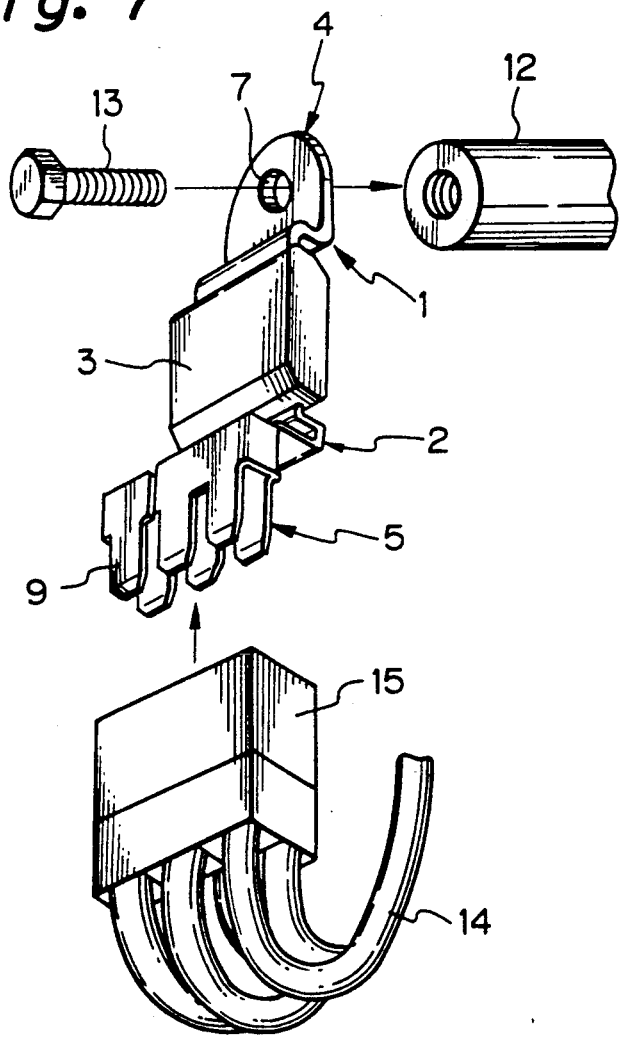
FIG. 7 is a disassembled perspective view of the electric connection terminal of the first embodiment in use.

As shown in FIG. 7, the earth bracket constructed by the manner mentioned above is attached to the aluminium body by securing the body connecting portion 4 of the first aluminium attaching member 1, to an aluminium mounting boss 12, by a bolt 13. An earth holder 15 supporting a plurality of earth lines 14 is connected to the tabs 9 of the earth connecting portion 5 of the second brass attaching member 2. Thus, the aluminium body is conducted to the earth lines 14 to form an earth circuit.

In the above embodiment of the earth bracket, the aluminium attaching member 1 and the brass attaching member 2 are embedded in the water-proof layer 3. Consequently, the coupling portions 6A and 6B prevents water from entering therein and protects the aluminium material against electric erosion.

Figure 8:
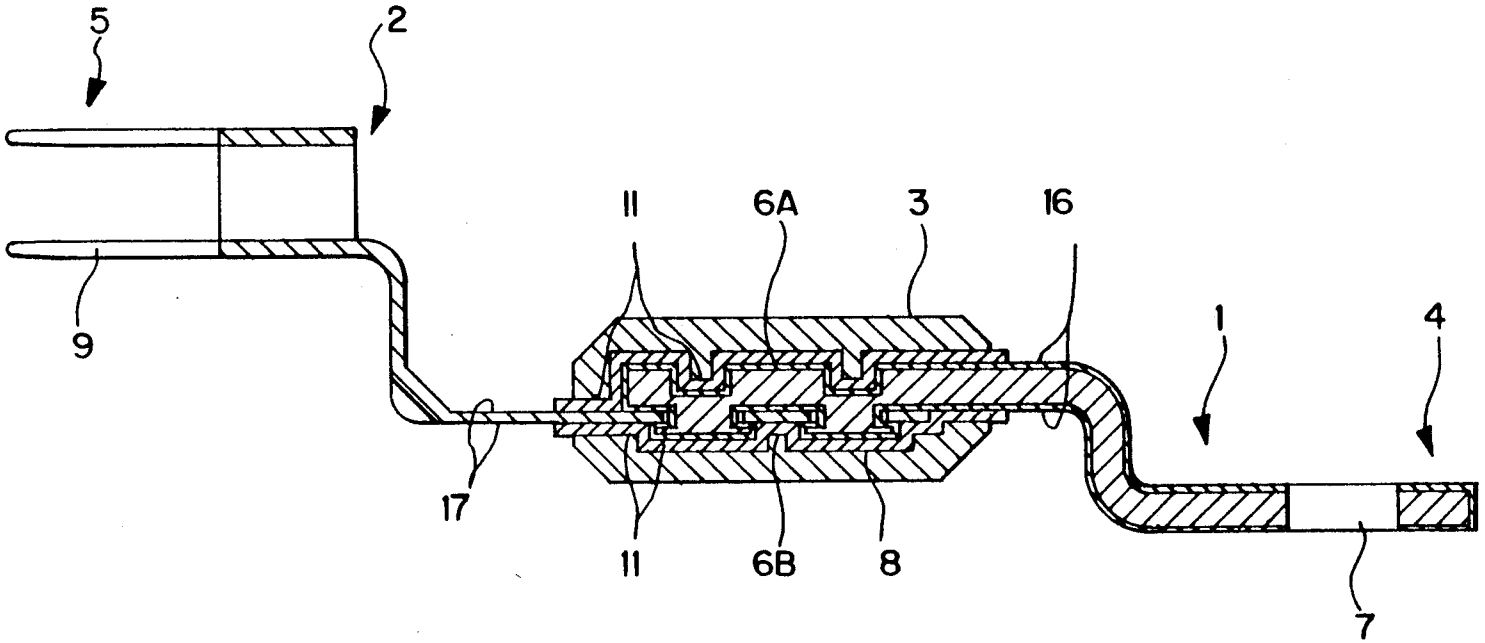
FIG. 8 is a longitudinal cross section of an electric connection terminal of a second embodiment in accordance with the present invention.

The second embodiment of this invention will be now explained by referring to FIG. 8. The second embodiment is similar to the first embodiment. The earth bracket of the second embodiment includes the first aluminium attaching member 1, the second brass attaching member 2, and the water-proof layer 3 embeding the coupling portions 6A and 6B. In the second embodiment, the first aluminium attaching member 1 is processed by chromate treatment and the second brass attaching member 2 is plated with tin. The respective surfaces of the members are covered with protecting films 16 and 17. The water-proof layer 3 is formed on the films 16 and 17 by molding.

Figure 1:
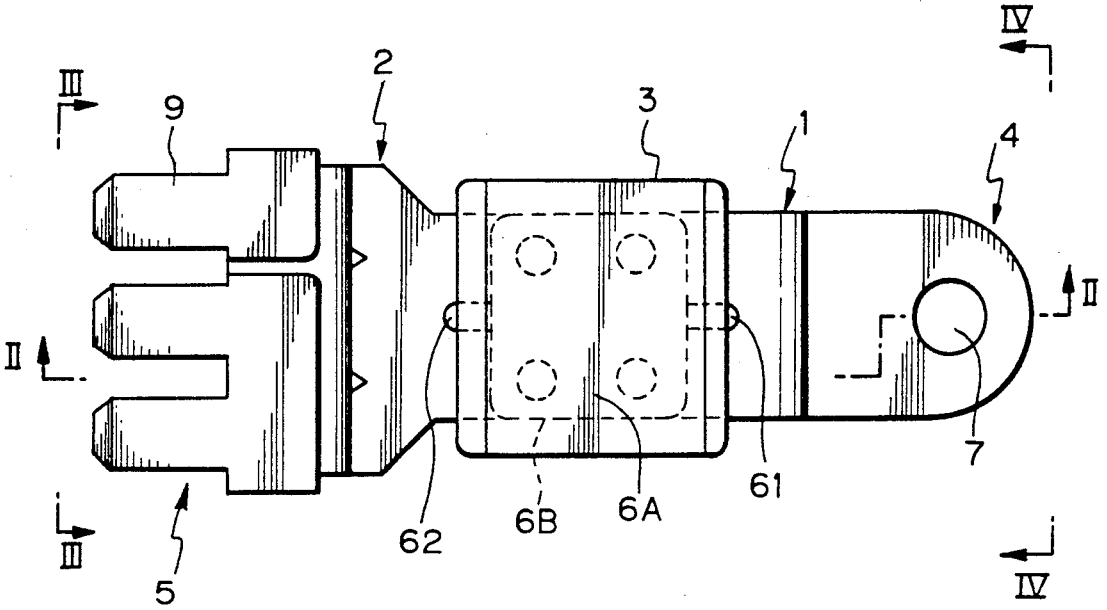
FIG. 1 is a plan view of an electric connection terminal of a first embodiment in accordance with the present invention.
Figure 2:
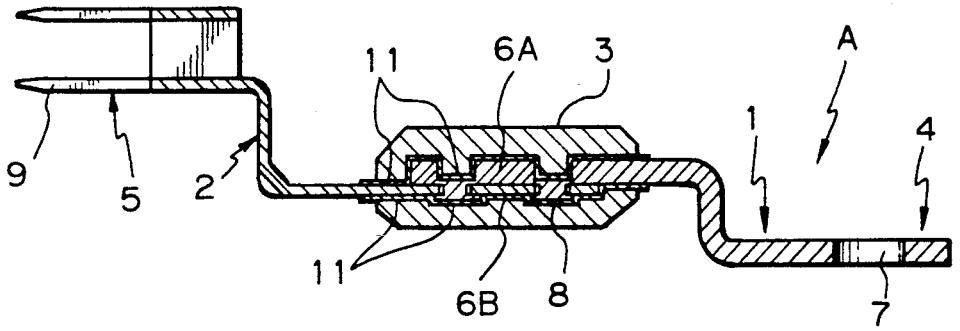
FIG. 2 is a cross sectional view taken along line II—II in FIG. 1.
Figure 3:
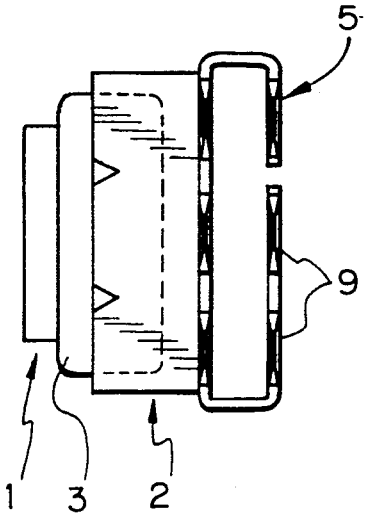
FIG. 3 is an end view seen from arrow III—III in FIG. 1.
Figure 4:
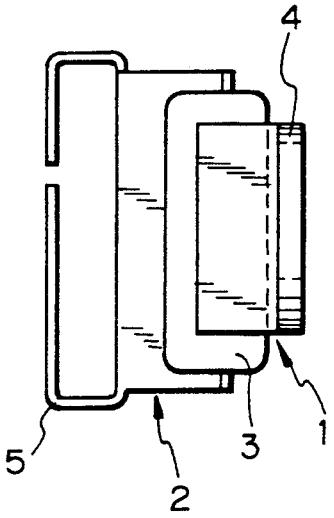
FIG. 4 is an end view seen from arrow IV—IV in FIG. 1.

The brackets of the first and second embodiments shown in FIGS. 2 and 8 were subject to a salt water resistance test under the same conditions. After continuously spraying salt water on the brackets for one hundred hours, the salt water entered in the space between the film 11 and the aluminium surfaces at the first embodiment, thus demonstrating erosion due to the salt water. However, there was no entering of the salt water in the second embodiment processed by the chromate treatment. It was confirmed that the chromate treatment is very advantageous for preventing the erosion caused by water or salt water.

Figure 9:
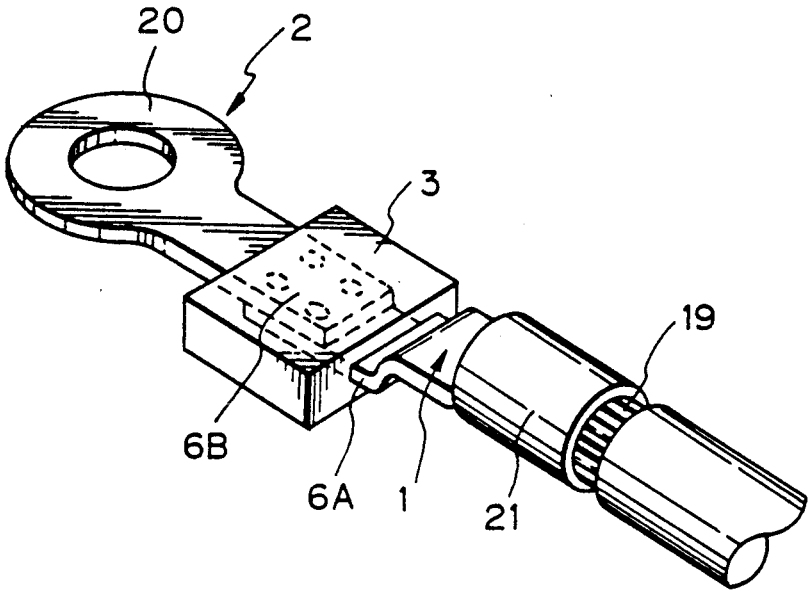
FIG. 9 is a perspective view of an electric connection terminal of a third embodiment in accordance with the present invention.

Referring now to FIG. 9, the third embodiment of the present invention is explained. FIG. 9 shows another electric connection terminal excluding the earth bracket mentioned above. This electrical connection terminal comprises the first aluminium attaching member 1 having a wire connecting portion 21 for an aluminium electric wire 19 at the top end and the coupling portion 6A, and the second brass attaching member 2 having at the top end a connecting portion 20 for connection to equipment and the coupling portion 6B at the bottom end. The first and second attaching members are superposed at the coupling portions 6A and 6B. The portions 6A and 6B are covered with the same water-proof layer 3 as that of the above embodiments by molding.

The aluminium electric wire 19 is connected to the wire connecting portion 21 of the first member 1 while the equipment, or a conventional electric wire, is connected to the connecting portion 20 of the second member 1, so as to make an electrical connection. The third embodiment of FIG. 9 has the same effect of preventing the electric erosion as that of the above embodiments.

The means for sticking the water-proof layer 3 to the surfaces of the attaching members 1 and 2 may be the adhesive film 11 mentioned above or another water-proof layer made of a plastic resin material having a good adhesion property to a metal surface, such as polybtyleneterephtalete resin disclosed in, for example, the specification of Japanese Patent Application No. 205506/1989. This water-proof layer can be directly attached to the terminal. The water-proof layer 3 made of the plastic resin having good adhesive properties assures that water does not enter into the space between the layer and the surfaces of the members 1 and 2. A simplified process for producing the earth bracket is also provided since the adhesive film 11 is not required.

It will be apparent from the above explanation that the electric connection terminal in accordance with the present invention can prevent electric erosion arising in a portion connected between an aluminium material and a metal material other than the aluminium material when a conventional electric wire is connected to some equipment made of aluminium or when an aluminium electric wire is connected to some equipment made of a material other than the aluminium material. As this invention will be useful in the promotion of automobiles having an aluminium body, this invention can respond to technical needs in the art, and can improve stability of electric conduction of electric equipment utilizing an aluminium material.

What is claimed is:

1. An earth bracket for electrically connecting an aluminum car body to earth wires, comprising:

an aluminum attaching member having a first coupling portion formed at one end thereof and a termination portion formed at the other end thereof, said termination portion having a hole formed therein so as to allow attachment to said aluminum car body by virtue of an aluminum bolt passing through said hole;

a second copper attaching member, having a second coupling portion at one end thereof, a plurality of protrusions formed on said second coupling portion;

a plurality of terminals at the other end of said second copper attaching member, said terminals being constructed so as to accept an end portion of the earth wires to be electrically connected to said aluminum car body;

said first coupling portions having apertures formed therein, each of said protrusions inserted into a respective one of said apertures, when said first and second coupling portions are disposed in overlapping relation to each other, so as to electrically and mechanically connect said aluminum attaching member and said second copper attaching member;

an adhesive layer disposed on said first and second coupling portions; and a plastic resin layer disposed on said adhesive layer so as to encapsulate overlapping portions of said first and second coupling portions.

2. An earth bracket as claimed in claim 1, further comprising:

a protecting layer disposed on said aluminum attaching member by virtue of chromate processing; and a tin plating layer disposed on said second copper attaching member.

3. An earth bracket as claimed in claim 1, wherein said aluminum attaching member is constructed of an aluminum alloy material and said copper attaching member is constructed of a copper alloy material.

* * * * *